United States Patent [19]

Rabuse

[11] 4,382,326

[45] May 10, 1983

[54] STAPLE SUPPORTING AND STAPLE REMOVING STRIP

[75] Inventor: George R. Rabuse, Sunfish Lake, Minn.

[73] Assignee: Minnesota Mining & Manufacturing Company, St. Paul, Minn.

[21] Appl. No.: 226,113

[22] Filed: Jan. 19, 1981

[51] Int. Cl.[3] ..... B25B 27/00

[52] U.S. Cl. ..... 29/270; 411/457

[58] Field of Search ..... 29/270; 411/461-466, 411/457, 471, 472; 206/633

[56] References Cited

U.S. PATENT DOCUMENTS

| | | | |
|---|---|---|---|
| 1,605,695 | 11/1926 | Baloyan | 411/477 |
| 1,839,543 | 1/1932 | Flood . | |
| 2,335,715 | 11/1943 | Wallace | 29/13 |
| 2,550,549 | 1/1951 | Goodstein | 411/461 |
| 2,716,748 | 9/1955 | Sutton | 1/2 |
| 3,610,087 | 10/1971 | Dritz | 85/49 |
| 4,129,059 | 12/1978 | Van Eck | 411/475 |

FOREIGN PATENT DOCUMENTS

| | | | |
|---|---|---|---|
| 530315 | 7/1955 | Italy | 411/443 |

*Primary Examiner*—James L. Jones, Jr.

*Attorney, Agent, or Firm*—Cruzan Alexander; Donald M. Sell; John C. Barnes

[57] ABSTRACT

A staple-supporting strip for use with staples when binding documents together which affords removal and retention of the staples without detrimental affect on the document. The staple-supporting strip comprises two narrow layers of tough flexible polymeric material between about 0.1 and 0.15 mm thick. The strip may be colored or printed with a staple target area and a coating of a pressure-sensitive adhesive holds the bottom layer of the strip on the uppermost sheet of the documents to be stapled together such that the top layer may be peeled from the lower layer to unclench the staple legs during removal.

15 Claims, 5 Drawing Figures

STAPLE SUPPORTING AND STAPLE REMOVING STRIP

DESCRIPTION

1. Technical Field

This invention relates to a polymeric strip which may be applied to the surface of a stack of sheets prior to the stapling of the sheets together such that upon peeling one layer of the strip away from the other the staples will be removed from the papers and retained in the upper layer of the strip.

2. Background Art

The present invention provides a useful device in the form of a thin elongate strip of polymeric material, folded upon itself which can be placed upon several or a stack of sheets, e.g., paper, to be stapled prior to the stapling. The staple, or successive staples, are then placed through the polymeric strip and the sheets. When it is desired to separate the sheets for filing, copying or microfilming the two layers of the strip are peeled apart withdrawing the staples from the sheets and the staples are retained in the polymeric strip. The staple supporting and staple removing strip disclosed in this application is an improvement over the earlier invention of copending application of Molenda and Rabuse, application Ser. No. 226,114, filed concurrently, wherein a single layer of polymeric material supports the staples.

The staple strip of this application utilizes a second layer of polymeric material to serve as the anvil for unclenching the legs of the staple during removal of the staple. This substantially eliminates having a staple not being unclenched during removal of the staple as the strip is peeled off documents stapled together, even with a staple through as few as two sheets of paper. The strip of this invention is utilized initially in the same manner as the strip with a single layer of material. If additional sheets must be added to the stack they may be placed behind the first sheets and an additional staple is placed through the polymeric strip and into the new sheet or sheets. Upon separation of the sheets the top layer of the strip is peeled from the uppermost sheet and is then peeled from the bottom layer of the strip to progressively lift the staples from the sheets and then to lift the strip from the sheets.

DISCLOSURE OF INVENTION

The present invention is directed to a staple-supporting strip for use in binding documents together and which affords removal of the staples when the strip is removed. The staple-supporting strip comprises two narrow elongate layers of polymeric material. The layers are preferably of different length and are aligned and joined at one end as by folding a longer strip. The polymeric material is tough transparent flexible material. The thickness of the strip is between about 0.1 and 0.15 mm (0.004 and 0.006 inch). The strip preferably has a width of between about 1.2 cm and 2.5 cm (0.5 and 1 inch). The top layer has a length of between 5 cm to 7.6 cm (2 to 3 inches). The shorter or bottom layer or polymeric material would be approximately 1.2 cm (0.5 inch) shorter than the top layer. The strip may be colored to afford identification or it may be printed on one layer of the strip with a transparent colored ink, leaving a window identifying the area for reception of the staples. A narrow coating of a readily releasable pressure-sensitive adhesive, extending transversely of the exposed surface of the bottom layer, and adjacent the free end thereof, will facilitate positioning of the strip on the uppermost sheet of the documents to be stapled together and holds the lower layer to the sheets during staple removal.

BRIEF DESCRIPTION OF DRAWINGS

The present invention will be more fully described hereinafter with reference to the accompanying drawing wherein.

BEST MODE FOR CARRYING OUT THE INVENTION

Figure 1:
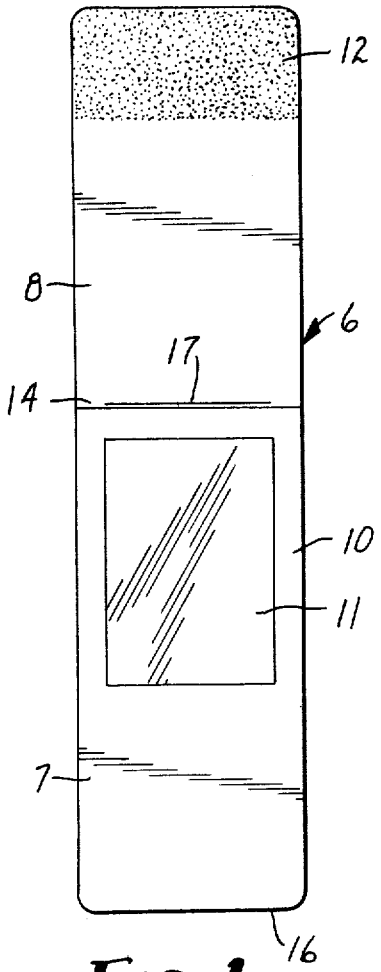
FIG. 1 is a plan view of a staple-supporting strip according to the present invention in an unfolded condition.
Figure 2:
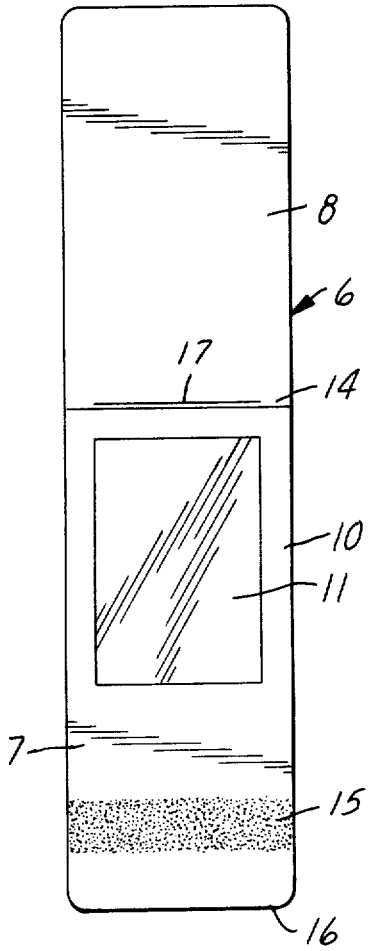
FIG. 2 is a bottom view of the staple-supporting strip of FIG. 1.

The present invention relates to a staple-supporting strip which affords the easy removal of one or more staples from a stack of sheets, e.g., papers, film fabric or the like.

The staple-supporting strip of the present invention is generally designated by the reference numeral 6 and provides a fast economical way of removing one or more staples in one operation after a stack of sheets having two and up to about fifteen sheets are stapled together. In many document handling operations, such as accounting, billing and the like, a pair of documents are stapled together and then perhaps additional documents are fastened to the first documents. This is true where the purchase order and letter are stapled together, then the shipping receipt is added and stapled, then the invoice is stapled to them, then perhaps the record of payment of the invoice, etc. until completion of the transaction. At this time all of the documents are separated and microfilmed to afford a permanent record of the transaction and the documents associated therewith. The documents must be separated prior to microfilming and it is generally necessary for clerical people to remove each of the staples to allow efficient machine handling. Removal of the staples using conventional staple removers takes a considerable amount of time, that is, time to align the removal device with the staple and time to remove each staple successively. Then, the staples usually are left lying around and find their way to the carpet, clothing or occasionally some of them drop into the microfilming or copying equipment. This is very undesirable in that additional time must then be taken to pick up the staples or to remove the same from the equipment. The staple-supporting strip of the present invention provides a cost effective staple removing and staple capturing device which provides a paper reinforcement at the stapled area when the documents are fastened. Furthermore, the staples are unclenched even when as few as two sheets of paper are stapled together, thus avoiding tearing of the paper as unclenched staples are pulled through a sheet of paper. The stable-supporting strip is preferably transparent and may be lightly colored such that it provides a means for locating the position of the staples and does not hide the printed matter beneath the staple-supporting strip. The color of the strip may be used to code different types of documents.

The staple-supporting strip 6 is made of tough flexible polymeric material which is transparent and preferably between about 0.1 and 0.15 mm (0.004 and 0.006 inch) thick and is preferably 0.0046 inch thick. The polymeric strip is preferably formed from polyethylene terephthalate (polyester) film which has been oriented, preferably from 3 to 3.5:1 in the machine direction and about 4:1 in the cross direction.

The staple-supporting strip 6 comprises two layers of material, preferably of different lengths to form a strip between about 1.2 and 2.5 cm (0.5 and 1 inch) wide and the top layer 7 being between about 5 and 7.6 cm (2 and 3 inches) long. The shorter or bottom layer 8 is preferably about 1.2 cm (½ inch) shorter than the top layer 7. The layered strip may be formed by folding one long strip of material or by aligning and joining, as by solvent, adhesive or heat sealing, two separate strips. If two different gauge films are desired (one for upper layer 7 and one for lower layer 8), the lower layer could be reduced in thickness to approximately 0.05 mm (0.002 inch) and still provide a satisfactory "anvil" effect to permit unclenching of the staple(s). The strip is used in fastening two or more sheets of paper and attaching the same with one staple, and to attach additional sheets of paper with additional staples. A staple strip of this size could accommodate up to approximately 8 staples 9 which are 1.2 cm (½ inch) wide at the crown and have a 0.6 cm (¼ inch) leg or prong.

As illustrated in FIG. 1, the top layer of strip 6 may be printed with a transparent ink 10 in selective areas, and as illustrated, provides a window 11 in the strip which will serve to define the desired staple receiving target area. The window is illustrated as 1.9 cm (¾ inch) wide and 2.85 cm (1⅛ inches) long, accommodating easily 8 staples. The window is spaced 2.5 cm (1 inch) from one end of the top layer 7, providing a lifting area or tab which may be grasped in one hand and peeled from the sheet and the bottom layer 8. This operation is illustrated schematically in FIG. 5. The ink may be applied to either layer and on either surface to define the staple receiving target area or window 11.

One example of a staple-supporting strip 5 comprises a strip of polyester film, having the preferred thickness of 0.00461 inch, with an orientation in the machine direction of 3 to 3½:1 and about 4:1 in the cross direction. The strip was tested as follows:

| | Property | ASTM Method | Units | Target | 95% Limits |
|---|---|---|---|---|---|
| Tensile-first | M.D. | D-882 | lbs./in. | 60.8 | 54.6–67.0 |
| 3% of stretch | C.D | D-882 | lbs./in. | 66.8 | 58.5–75.1 |
| Tensile - at | M.D. | D-882 | lbs./in. | 130.0 | 130.5–156.5 |
| break | C.D. | D-882 | lbs./in. | 182.0 | 151.6–212.4 |
| Elongation | M.D | D-882 | % | 150.0 | 110.0–190.0 |
| | C.D. | D-882 | % | 85.0 | 55.0–115.0 |
| Thickness | | — | inch | 0.00461 | 0.00433–0.00489 |

Films other than polyester lack the necessary properties such as toughness, and/or flexibility, and/or cost advantages. This is true with metal foils which would be suitable although opaque. The other films tried were made of polyethylene, polypropylene, polycarbonate, regenerated cellulose, cellulose acetate—triacetate—butyrate—propionate, polyamide (nylon), polyvinyl chloride (plasticized and unplasticized), nonwovens, polyester/polyethylene laminates, polystyrene (plain and rubber modified) and filament tape. A suitable film must have a combination of high-tensile strength, at low elongation, high tear strength and high bursting strength.

Strips 6 made of polyester film as described above were tested with respect to usage involving one strip 6, one staple, and two or more pieces of paper.

The procedure followed and results are outlined below:

Test Equipment—Instron® Model TM; cross-head speed—50 inches/min.

Stapler—Swingline® 94-41

Staples—Swingline® Standard Staples No. 35-2D (½ inch wide, ¼ inch leg)

Paper—Secretary® 696 Type White Bond

| No. of Sheets of Paper | No. Staples | Removal Force (gms.)* | Observations |
|---|---|---|---|
| 2 | 1 | 840 | Staple unclenched |
| 3 | 1 | 860 | " |
| 4 | 1 | 910 | " |
| 5 | 1 | 890 | " |
| 6 | 1 | 900 | " |
| 7 | 1 | 900 | " |
| 8 | 1 | 970 | " |
| 9 | 1 | 910 | " |
| 12 | 1 | 980 | " |
| 15 | 1 | 1010 | " |
| 18 | 1 | 1080 | One leg of staple still in paper<br>Staple completely torn thru strip |
| 21 | 1 | 1090 | One leg of staple still in paper<br>Staple completely torn thru strip |
| 30 | 1 | 1250 | One leg of staple still in paper<br>Staple completely torn thru strip |

*As the number of sheets increases, the force required for staple removal increases principally because the length of the clenched part of the staple decreases thereby shortening the length of the bending moment.

The test shows a failure beginning when attempting removal of the staple from more than 15 sheets of paper. This is substantially the limit, however, for effective stapling with this common size staple.

Figure 5:
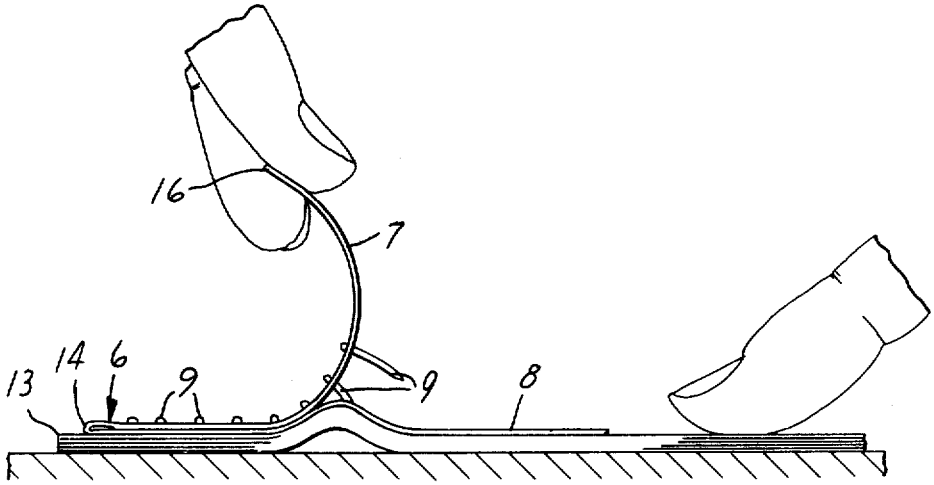
FIG. 5 is a schematic view of the removing of a staple-supporting strip and the staples from a stack of sheets.

The removal of the strip and staples is afforded by peeling the upper layer from the sheet and from the lower layer by grasping the free end of the upper layer as shown in FIG. 5. It is important that the lower layer have means for holding the free end thereof in place on the upper sheet during the peeling so that the lower layer serves as an anvil to unclench the staples. This means for holding the lower layer is illustrated as a readily releasable pressure-sensitive adhesive 12 that will permit removal without tearing the paper fibers or lifting the printed indicia on the sheet but has the integrity to hold the lower layer in place when the top layer is being peeled from the lower layer during removal of the staples.

The preferred pressure-sensitive adhesive for the layer 12 is an acrylate copolymer microsphere structured adhesive as disclosed in U.S. Pat. Nos. 3,691,140 issued to Silver on Mar. 3, 1970 and 3,857,731 issued to Merrill et al on Apr. 6, 1973. This type adhesive allows for the removal or repositioning of the staple-supporting strip without injury to the paper surface or lifting the printing therefrom.

Figure 3:
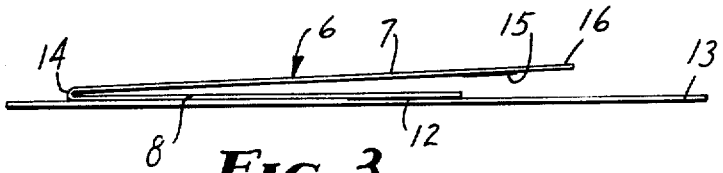
FIG. 3 is a side elevational view of the staple-supporting strip on a sheet.
Figure 4:
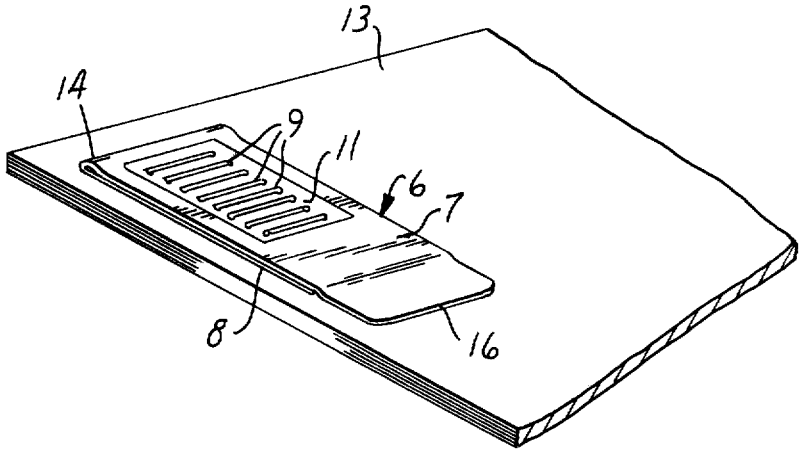
FIG. 4 is a schematic perspective view of the staple-supporting strip on top of a stack of sheets.

As shown in FIGS. 1 and 3, the adhesive 12 is coated onto the exposed surface of lower layer 8 adjacent the free end, which end is opposite the end 14 of the layer joined to layer 7. A narrow band 15 of this same adhesive may also be placed on the upper layer 7 on the surface positioned toward the top sheet of paper 13. This adhesive coating 15 also holds the upper layer in place on the sheet and affords a tab 16 allowing one to readily grasp and begin to peel the layers apart.

The adhesive strips 12 and 15 may be applied as strips of a double coated adhesive tape. The tape is coated on one side with a high-tack (permanent) pressure-sensitive adhesive and on the other side with an acrylate copolymer microsphere structured adhesive as disclosed above. The high-tack adhesive, e.g., the adhesive disclosed in U.S. Pat. No. Re. 25,906, coated surface of the tape is applied against the staple-supporting strip. The tape backing can be a polyester film and the tape thickness (with the two adhesive coated surfaces) would be approximately 0.08 mm (0.003 inch). A release liner is generally applied to the microsphere structured adhesive prior to lamination to the strip. Alternatively, the adhesive layers 12 and 15 could be strip coated direct to the polyester film.

Strips 6, when formed by folding a long narrow strip to obtain the two layer construction of layers 7 and 8, have an improved "lay flat" characteristic when a slit 17 is made in the strip extending through the strip at the fold line.

A manufacturing method comprises the use of six inch wide polyester film. The window design is first printed on the polyester film as shown in FIG. 1 using a Flexotuf Process ink supplied by Inmount Corporation of Clifton, N.J. 07012. The double coated tape then is laminated to the adhesive areas 12 and 15. The release liner is removed from the tape and a paper liner is laminated to the six inch wide film to facilitate the subsequent die cutting operation to form the long narrow strips. After die cutting, the paper liner is removed, the long strip is creased and folded transversely at the indicated point, and the strips 6 are stacked into piles of appropriate height for later packaging into a box.

Having disclosed a preferred embodiment of the present invention and alternative embodiments, it is to be understood that this invention is directed to a narrow strip of a sufficiently tough flexible polymeric film to receive the ubiquitous staple in a transverse placement and support the crown of each staple as the layers of the strip are peeled apart. The lower layer remains in place on the sheet to unclench the legs of the staple as the crown is pulled away from the lower layer and the sheets. This staple-supporting strip when applied prior to stapling reduces staple removal time and captures the removed staples for easy disposal.

I claim:

1. A staple-supporting strip for use in overlaying sheets to be stapled and affording subsequent removal and retention of the staples comprising two narrow elongate layers of tough flexible polymeric material, comprising an upper layer and a lower layer with the layers joined at one end, said upper layer having a thickness of between about 0.1 and 0.15 mm (0.004 and 0.006 inch) and the lower layer having a thickness between 0.05 mm and 0.15 mm (0.002 and 0.006 inch) and having a width dimension of between about 1.2 cm and 2.5 cm and having a length of between about 5 cm and 7.6 cm (2 and 3 inches), and means on the exposed surface of said lower strip for temporarily adhering said strip to the surface of a sheet and for holding said free end of said lower layer to said sheet when the upper layer is peeled away from said lower layer to remove the staples.

2. A staple-supporting strip as defined in claim 1 wherein said upper layer is longer than the lower layer.

3. A staple-supporting strip according to claim 1 or 2 wherein said strip is formed of polyethylene terephthalate.

4. A staple-supporting strip according to claim 1 wherein said means for adhering and holding comprises a readily releasable pressure-sensitive adhesive.

5. A staple-supporting strip according to claim 4 wherein said adhesive is an acrylate copolymer microsphere structured adhesive.

6. A staple-supporting strip according to claim 4 wherein said adhesive is a narrow strip of double coated pressure-sensitive adhesive tape applied to said exposed surface of said lower layer, with the surface of said tape exposed having a readily releasable pressure-sensitive adhesive coated thereon.

7. A staple-supporting strip according to claim 6 wherein said readily releasable adhesive is an acrylate copolymer microsphere structured adhesive.

8. A staple-supporting strip according to claim 1 wherein one of said upper and lower layers has a coating of transparent colored ink printed on one surface thereof.

9. A staple-supporting strip according to claim 8 wherein said ink is printed on said upper layer to define a rectangular staple-receiving target area on said surface.

10. A staple-supporting strip according to claim 2 wherein said upper layer has means for temporarily adhering the extended end thereof to the surface of a said sheet when said strip is applied to a said sheet and said exposed surface of said lower layer is placed on a said sheet.

11. A staple-supporting strip according to claim 10 wherein said means for adhering said strip and said means for adhering said extended end of said upper layer comprises an acrylate copolymer microsphere structured adhesive.

12. A staple-supporting strip according to claim 10 wherein said upper layer has a coating of transparent colored ink on one surface thereof, said ink coating being applied selectively to define a rectangular staple-receiving target area on said strip.

13. A staple-supporting strip according to claim 1 wherein said strip is formed by folding an elongate strip of said polymeric material transversely.

14. A staple-supporting strip according to claim 2 wherein said strip is formed by folding an elongate strip of said polymeric material transversely with the edges aligned.

15. A staple-supporting strip according to claim 11 wherein said strip is formed by folding a long narrow strip of said polymeric material transversely with the edges aligned.

* * * * *